US005988580A

United States Patent [19]

Bucher et al.

[11] Patent Number: 5,988,580

[45] Date of Patent: Nov. 23, 1999

[54] AESTHETIC COMPONENTS FOR CEILING FANS

[75] Inventors: John C. Bucher, Ft. Lauderdale; Charles E. Bucher, Valrico, both of Fla.

[73] Assignee: King of Fans, Inc., Ft. Lauderdale, Fla.

[21] Appl. No.: 08/766,245

[22] Filed: Dec. 13, 1996

[51] Int. Cl.[6] ..... B42F 13/00

[52] U.S. Cl. ..... 248/343; 248/694; 416/5

[58] Field of Search ..... 248/27.1, 222.52, 248/225.11, 223.21, 345, 343, 222.51, 222.41, 694; 220/241; 416/5

[56] References Cited

U.S. PATENT DOCUMENTS

| | | | |
|---|---|---|---|
| 1,224,576 | 5/1917 | Smith | 220/3.3 |
| 1,471,494 | 10/1923 | Lubow | 248/343 |
| 2,215,331 | 9/1940 | Marsh | 248/251 |
| 3,378,221 | 4/1968 | Wolar et al. | 248/343 |
| 3,676,986 | 7/1972 | Reiling | 55/472 |
| 4,518,314 | 5/1985 | Schultz | 416/93 R |
| 5,302,083 | 4/1994 | Bucher et al. | 416/5 |
| 5,507,619 | 4/1996 | Ryan | 416/5 |
| 5,658,129 | 8/1997 | Pearce | 416/5 |

*Primary Examiner*—Leslie A. Braun
*Assistant Examiner*—Anita M. King
*Attorney, Agent, or Firm*—Stein, Schifino & Van Der Wall

[57] ABSTRACT

A canopy screw cover for aesthetically covering the mounting screw heads of a ceiling fan canopy, comprising a mounting screw having a head, an annular ring, and a recess formed in the annular ring in which is positioned the head of the mounting screw when the annular ring is positioned about the canopy.

4 Claims, 8 Drawing Sheets

AESTHETIC COMPONENTS FOR CEILING FANS

BACKGROUND OF THE INVENTION

1. Field of the Invention

This invention relates to ceiling fans. More particularly, this invention relates to aesthetic components for ceiling fans which aesthetically conceal various unsightly mechanical aspects of the ceiling fan from view.

2. Description of the Background Art

Motor driven fans suspended from the ceiling were used extensively in homes in the United States to provide air circulation before the introduction and popularization of central cooling units.

When the energy crisis dawned in the 1970s, the cost of a kilowatt hour skyrocketed in price and consumers searched for ways to reduce their heating and cooling costs. It has been well established that properly circulated air will raise the overall thermal efficiency of the home air conditioning and cooling system and hence, reduce the cost of maintaining a home at a desired comfort level year-round. Thus, ceiling fans were repopularized in the 1970s.

Indeed, ceiling fans have become so popular that competitiveness in the industry often depends upon the aesthetic features of one ceiling fan versus another. Hence, ceiling fans are usually designed with aesthetically pleasing canopies, motor housings, fan blades, and switch housings. Furthermore, a large variety of stylized light kits have been designed which may be readily connected to the ceiling fan's switch housing. Most predominantly, such light kits comprise three or four stylized bulb reflectors (for conventional incandescent bulbs), each of which may be pivoted in a different direction for spot lighting.

Unfortunately, even with the most aesthetic features incorporated within a ceiling fan, several mechanical aspects of the ceiling fan are not concealed from view by the consumer. Specifically, typical canopies are designed to conceal a conventional hanger bracket (secured to the electrical junction box in the ceiling) from which the ceiling fan is suspended by means of a down rod. The conventional design of such a canopy includes a plurality of holes formed about its upper peripheral rim. Such holes allow the canopy to be secured into position about the hanger bracket by means of machine screws which extend through the holes into corresponding threaded holes in the hanger bracket itself. Unfortunately, once installed in such a manner, the heads of the machine screws remain visible and create an unsightly appearance.

Furthermore, it is noted that more modern canopies, commonly referred to as "dual-mount" or "combo" canopies, that can be alternatively used with conventional down rods to suspend the ceiling fan from the ceiling or used as a means for directly connecting the ceiling fan to the hanger bracket to be substantially flush with the ceiling. This alternative combination is achieved by means of a plurality of holes formed in their lowermost peripheral rim of the canopy. The holes allow the canopy to be directly connected to the upper surface of the motor housing of the ceiling fan by means of machine screws so that the motor housing can be connected directly to the hanger bracket. However, in such a combo canopy, it is noted that the mounting holes present an unsightly appearance when the canopy is used for conventional down rod applications. Therefore, there presently exists a need in the ceiling fan industry for a way to conceal the machine screws and holes of such conventional canopies so that a more aesthetically pleasing appearance is presented to consumers.

Apart from conventional canopies, there are other components of conventional ceiling fans that do not present an aesthetically pleasing appearance to consumers. For example, most ceiling fans include two switches with pull chains mounted in the switch housing, one for controlling the on and off operation of a light kit that may be attached to the switch housing and the other for controlling the high/medium/low/off operation of the electric motor. In both instances, the switch is mechanically secured through a hole in the wall of the switch housing and secured into position by means of an unsightly knurled nut. Further, most ceiling fans include a slide switch, called a reverse switch, for controlling the clockwise and counter-clockwise operation of the electric motor. Typically, the reverse switch is mounted through a wall of the switch housing in such a manner that the switch knob extends through a hole in the wall of the switch housing. The mounting screws as well as the switch knob present an unsightly appearance to consumers.

Therefore, it is an object of this invention to provide an improvement which overcomes the aforementioned inadequacies of the prior art devices and provides an improvement which is a significant contribution to the advancement of the ceiling fan art.

Another object of this invention is to provide a canopy screw cover for concealing the mounting screws that attach the upper peripheral rim of a canopy to a conventional hanger bracket so as to present an aesthetically pleasing appearance to consumers.

Another object of this invention is to provide a canopy hole cover that conceals the mounting holes in the lower peripheral rim of a combo canopy that would otherwise remain visible when the ceiling fan is suspended from the hanger bracket by means of a down rod.

Another object of this invention is to provide a pull chain grommet and coupler assembly for mounting a pull chain switch to the wall of a switch housing thereby presenting an aesthetically pleasing appearance to consumers.

Another object of this invention is to provide a reverse switch cover having an aesthetically and ergonomically pleasing appearance which is designed to be mounted to the wall of the switch housing about the switch knob and mounting screws of the reverse switch so as to conceal the unsightly knob and mounting screws thereof and present an aesthetically pleasing appearance to the consumer.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention includes a variety of aesthetic components for ceiling fans that are designed to conceal otherwise unsightly screw heads, holes and switches so that the ceiling fan has a more aesthetically pleasing appearance.

More particularly, one aesthetic component of the invention is a reverse switch cover having an aesthetically pleasing outward appearance so as to conceal the otherwise unsightly knob of the slide switch and associated mounting screws. Apart from the aesthetically pleasing outward appearance, the cover includes, in some embodiments, a structure that allows it to be conveniently installed without any modification to the design of conventional switch housings and slide switches and, in other embodiments, a structure for installation about a reverse switch that is recessed-mounted in the switch housing.

Another aesthetic component of the invention includes a pull-chain grommet and coupler assembly which functions to replace the older-style knurled nut with a more streamline, aesthetically pleasing grommet. The outward appearance of the grommet may include a dome shape that appears to be substantially flush with the outer surface of the switch housing. Alternatively, when intended to be used in an outdoor environment potentially subject to wet conditions, the outer configuration of the grommet may be tapered slightly downwardly so that precipitation such as rain cannot enter into the switch housing via the grommet.

Another aesthetic component of the invention is a canopy screw cover that is designed to conceal the mounting screws that attach the canopy at its upper rim to the hanger bracket. Preferably, the canopy screw cover of the invention includes an annular ring having a diameter slightly greater than the diameter of the upper rim of the canopy. In one embodiment, recesses, preferably J-shaped, are formed in the lumen or inner surface of the annular ring in alignment with the mounting holes formed in the upper rim of the canopy. During installation, the annular ring is positioned concentrically about the upper rim of the canopy with the heads of the mounting screws in alignment with the recesses. The annular ring is then twist-locked into a locked position, thereby concealing the heads of the mounting screws. In another embodiment, an annular groove is formed in the lumen of the annular ring that allows the canopy screw cover to be snapped onto the upper rim of the canopy, thereby eliminating the need for any alignment of recesses.

Finally, another aesthetic component of the invention is a canopy hole cover having a design that conceals the otherwise visible holes in the lowermost peripheral rim or base of a conventional combo canopy designed for dual mounting of the ceiling fan via a down rod or directly to the hanger bracket. The canopy hole cover includes an annular flat plate with upwardly extending protrusions that are appropriately positioned in alignment with the holes to engage into the holes by pushing, thereby concealing the otherwise visible holes in the base of the canopy.

From the foregoing, it should be appreciated that the various aesthetic components of the invention solve needs in the industry for ways for increasing the aesthetic appearance of ceiling fans.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Reverse Switch Cover

Figure 1:
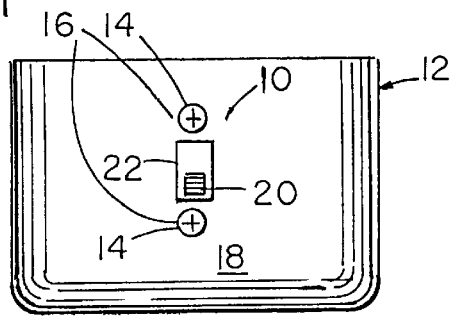
FIG. 1 is a side view of a prior art switch housing illustrating a conventional reverse switch mounted vertically therein.

As shown in FIG. 1, a conventional reverse switch 10 of a conventional ceiling fan (not shown) is mounted on the inside of a switch housing 12 by a pair of mounting screws 14 that extend through a pair of holes 16 from the wall 18 of the switch housing 12 for threaded engagement with the reverse switch 10. The switch knob 20, usually square-shaped, extends through a rectangular hole 22 formed in the wall 18 of the switch housing 12. It is noted that the rectangular hole 22 is of sufficient length to allow clearance for the back and forth movement of the switch knob 20 between its two switch positions.

Figure 2:
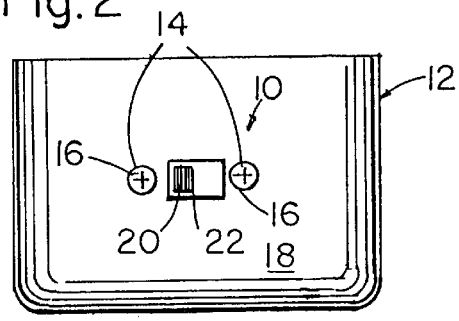
PRIOR ART Fig. 2
FIG. 2 is a side view of a prior art switch housing illustrating a conventional reverse switch mounted horizontally therein.
Figure 3A:
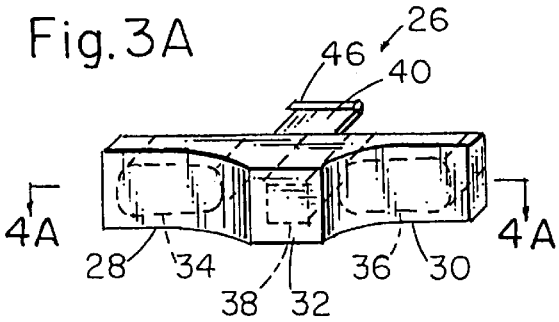
PRIOR ART Fig. 3A
FIG. 3 is a frontal perspective view of one embodiment of the reverse switch cover of the invention and FIG. 3A is a frontal perspective view of the same embodiment but with mounting tabs.
Figure 5A:
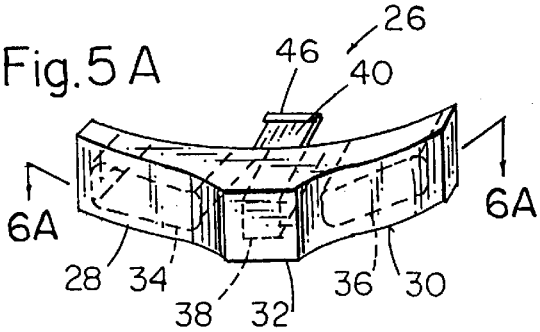
FIG. 5 is a frontal perspective view of another embodiment of the reverse switch cover of the invention and FIG. 5A is a frontal perspective view of the same embodiment but with mounting tabs.
Figure 4A:
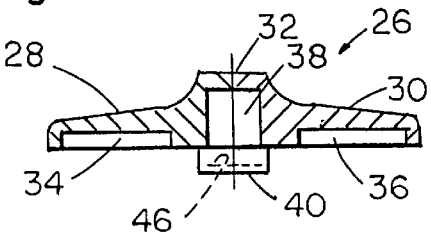
FIG. 4 is a cross-sectional view of FIG. 3 along lines 4—4 and FIG. 4A is a cross-sectional view of FIG. 3A along lines 4A—4A.
Figure 6A:
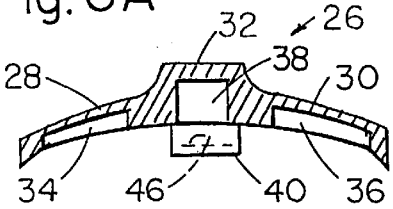
FIG. 6 is a cross-sectional view of FIG. 5 along lines 6—6 and FIG. 6A is a cross-sectional view of FIG. 5A along lines 6A—6A.

FIG. 1 illustrates the reverse switch 10 positioned longitudinally (vertically) relative to the longitudinal axis 24 of the switch housing 12. As shown in FIG. 2, the reverse switch 12 may be positioned transverse (horizontally) relative to the longitudinal axis 24 of the switch housing 12.

The various embodiments of the reverse switch cover 26 of the invention is illustrated in FIGS. 3–14. More particularly, the embodiments of the reverse switch cover 26 of the invention that are illustrated in FIGS. 3 & 3A and 4 & 4A are intended for use with a reverse switch 10 that is positioned longitudinally (vertically) within the wall 18 of the switch housing 12 as shown in FIG. 1 whereas the embodiments of the reverse switch cover 26 of the invention that are illustrated in FIGS. 5 & 5A and 6 & 6A are intended for use in connection with a reverse switch 10 that is positioned transverse (horizontally) to the switch housing 12 as shown in FIG. 2. Notably, the only difference between the two sets of embodiments is the fact that in the embodiments of FIGS. 5 & 5A and 6 & 6A, the reverse switch cover 26 includes an arcuate configuration having a radius substantially equal to the radius of the wall 18 of the switch housing 12 so that it fits smoothly against the outer surface 17 thereof. Still other embodiments of the reverse switch cover 26 will be described and illustrated with arcuate configurations for use in relation to the reverse switch positioning of FIG. 1; however, it shall be understood that flat configurations may be employed for use in relation to the reverse switch positioning of FIG. 2.

Figure 4:
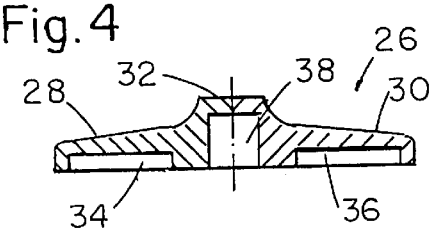
Figure 6:
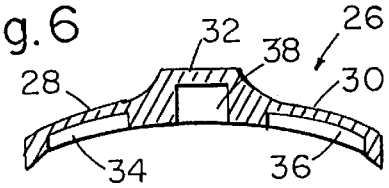

As best shown in FIGS. 4 and 6, both sets of such embodiments of the reverse switch cover 26 include an outer configuration comprising side portions 28 and 30 positioned on opposing sides of a protruding portion 32. Interiorly, the inward surface of each of the side portions 28 and 30 include an elongated recess 34 and 36 that are dimensioned to slidably receive the respective heads of the mounting screws 14. The inward surface of the protruding portion 32 includes a generally square recess 38 for receiving the switch knob 20 of the reverse switch 10.

With regard to the embodiments of FIGS. 3, 4, 5 and 6, the square recess 38 is dimensioned relative to the switch knob 20 such that the switch knob 20 is press fitted into the square recess 38 and is retained therein by the tight fit due to the inherent resiliency of the material constituting the cover 26.

Figure 2A:
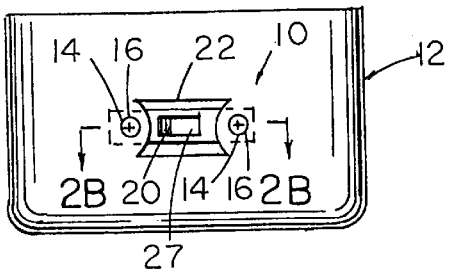
FIG. 2A is a side view of a switch housing installed within a butterfly shaped hole for receiving the tabbed embodiments of the reverse mounted cover of the invention.
Figure 2B:
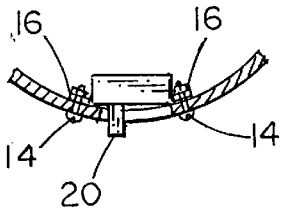
FIG. 2B is a cross-sectional view of FIG. 2A along lines 2B—2B.
Figure 3:
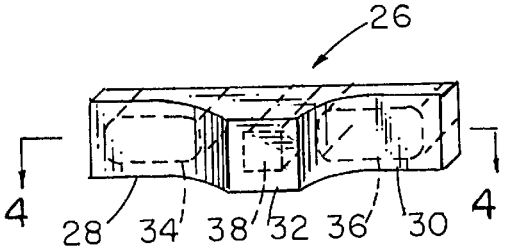

In regard to the embodiments of FIGS. 3A, 4A, 5A and 6A, the reverse switch cover 26 is secured into position by means of inwardly extending opposing tabs 40 and 42 which are sufficiently thin to be inserted within the opposing spaces between switch knob 20 and the edge of a modified hole 22 having a butterfly-shaped configuration (see FIGS. 2A and 2B). The butterfly hole 22 includes a width that is appreciably greater than the width of the switch so as to allow room for the tabs 40 and 42. Further, the shape of the butterfly hole 22 allows back and forth movement of the tabs 40 and 42 without interference.

Each of the tabs 40 and 42 include a barb 46 extending away from each other such that when the tabs 40 and 42 are inserted into the butterfly hole 22, the barbs 46 snap under the lip of the edge of the butterfly hole 22 thereby securing the reverse switch cover 26 into position.

Most notably, due to aforementioned construction, the tabs 40 and 42 are allowed to slide within the rectangular hole 22 such that back and forth movement of the reverse switch cover 26 (conveniently by a person's thumb engaging the protruding portion 32) causes back and forth movement of the switch knob 20 from one switch position to the other. Also notably, due to the length of the elongated recesses 34 and 36, the heads of the mounting screw 14 are allowed to slide within such recesses without any interference with the cover 26 itself. Thus, it should be appreciated that the reverse switch cover 26 may be installed by simply aligning the square recess 38 of the cover 26 with the switch knob 20 and then pushing on the cover 26 to snap the tabs 40 and 42 into the butterfly hole 22 until barbs 46 engage under the edge of the lip thereof.

Furthermore, it is noted that in regard to the horizontal configurations, the square recess 38 is preferably dimensioned sufficiently large to allow movement of the switch knob 20 within the square recess 38 as the cover 26 is moved back and forth, thereby assuring that no binding of the switch knob 20 relative to the cover 26 occurs during switching.

Figure 7:
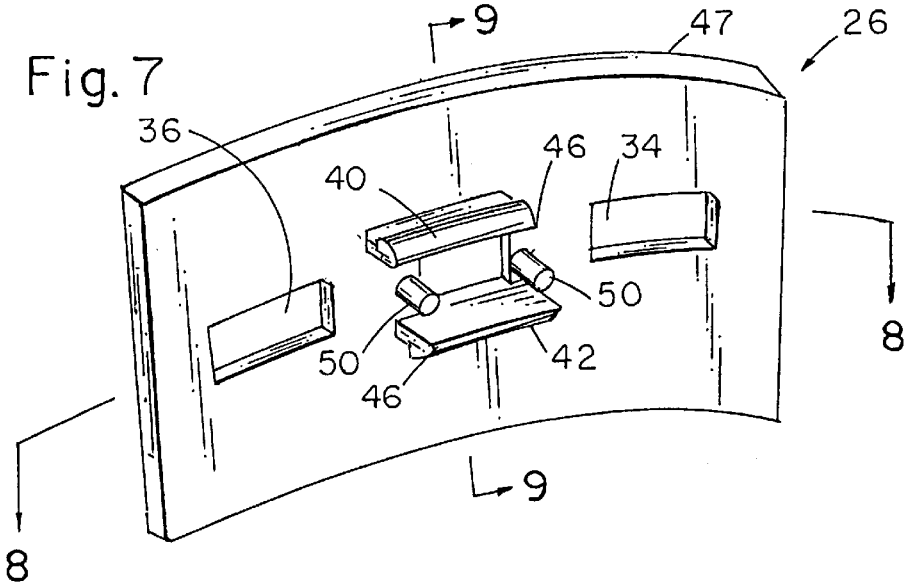
FIG. 7 is a rearward perspective view of another embodiment of the reverse switch cover of the invention.
Figure 8:
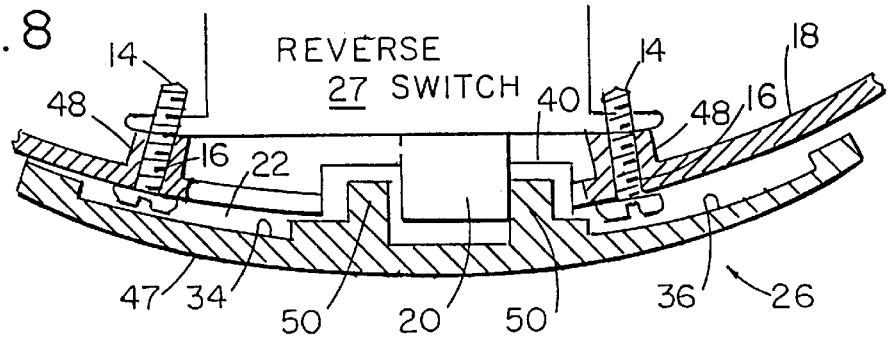
FIG. 8 is a cross-sectional view of FIG. 7 along lines 8—8 with the switch cover mounted about a recessed reverse switch installed in a switch housing.
Figure 9:
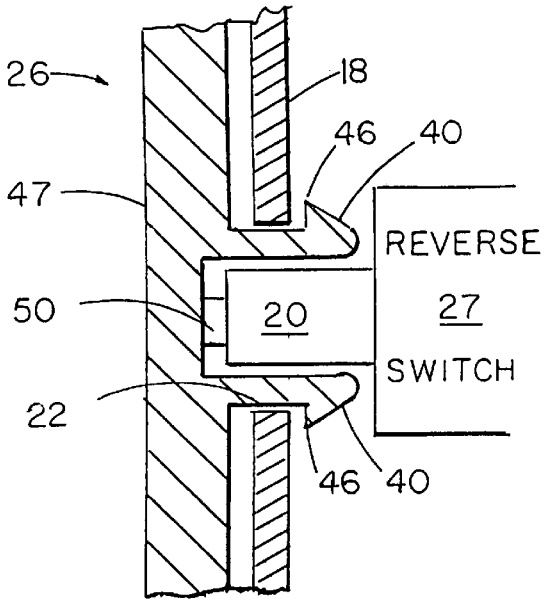
FIG. 9 is a cross-sectional view of FIG. 7 along lines 9—9 with the switch cover mounted about a recessed reverse switch installed in a switch housing.

Referring now to FIGS. 7–9, another embodiment of the reverse switch cover 26 includes smooth configuration 47 suitable for affixation of an emblem, advertisement or other indicia that creates a more flush appearance than the embodiments described above. In this smooth configuration 47 embodiment of the reverse switch cover 26 of the invention, the reverse switch 27 is mounted in a recessed position within the switch housing 12 by means of a spacers or stand-offs 48 positioned about each of the mounting screws 14. The smooth configuration 47 embodiment includes elongated recesses 34 and 36 and tabs 40 and 42 with barbs 46 as described in the above embodiments. However, in lieu of the square recess 38 of the embodiments described above, the smooth configuration 47 embodiment includes a pair of inwardly extending posts 50 that engage opposing sides of the switch knob 20. During use, back and forth movement of the smooth configuration 47 by a person's thumb or finger, causes the switch knob to be moved back and forth between the two switch positions, thereby reversing the direction of rotation of the electric motor.

Figure 10:
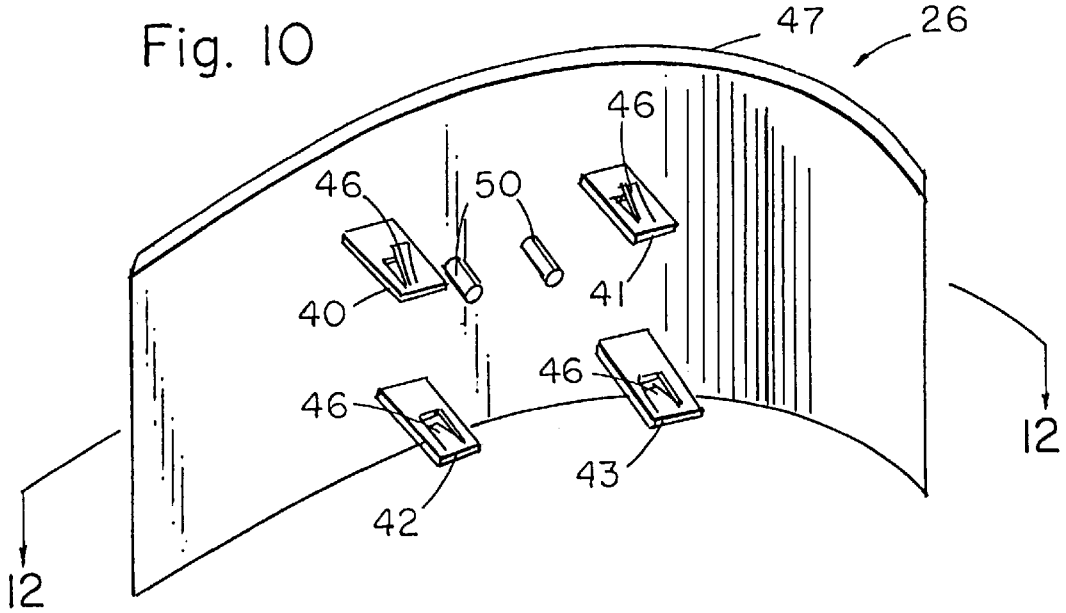
FIG. 10 is a rearward perspective view of another embodiment of the reverse switch cover of the invention.
Figure 11:
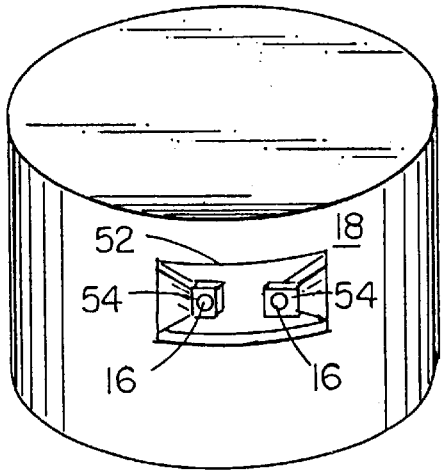
FIG. 11 is a perspective view of a recess formed in the side of the switch housing to which is mounted a reverse switch.
Figure 12:
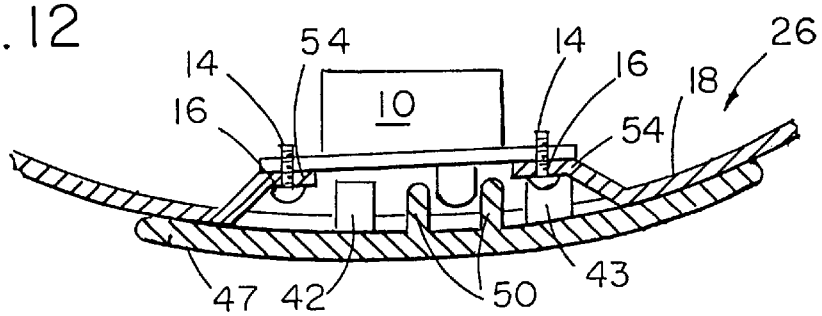
FIG. 12 is a cross-sectional view of FIG. 10 along lines 12—12 with the switch cover mounted about a recessed reverse switch installed in a switch housing.

As shown in FIGS. 10–12, another embodiment of the reverse switch cover 26 of the invention comprises a similar smooth configuration 47 and is similarly intended to be used in connection with a recessed reverse switch 10. However, unlike the embodiment shown in FIGS. 7–9, in this embodiment, the wall 18 of the switch housing 12 is bent inwardly by a punching operation to the configuration shown in FIG. 11 such that butterfly-shaped opening 52 is formed with recessed landings 54 extending toward the center of the opening 52. Holes 16 for the mounting screws 14 of the reverse switch 10 are formed in the landings 54. In this manner, the reverse switch may be secured by screws 14 to the landings 54 in the desired recessed position. The switch cover 26 of the invention includes the posts 50 as previously described. However, in lieu of the pair of tabs 40 and 42 as described above, preferably this embodiment includes four tabs 40, 41, 42 and 43, two at the top 40 & 41 and two 42 & 43 at the bottom and all with barbs 46, that engage and snap into the opening 52. Notably, the need for the elongated recesses 36 and 38 as shown in the previous embodiments is eliminated due to the recessing of the switch 10. Similar to the above embodiments, the smooth configuration 47 may be moved back and forth to cause back and forth movement of the switch knob 20 between the two switch positions.

Figure 13:
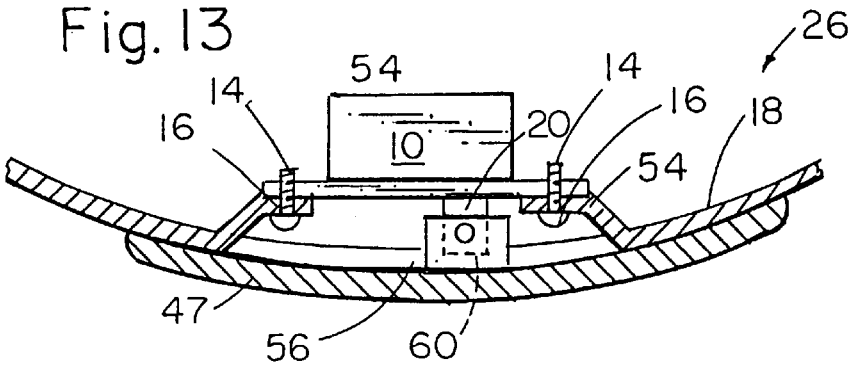
FIG. 13 is a cross-sectional view of another embodiment of the reverse switch cover of the invention mounted about a recessed reverse switch installed in a switch housing.
Figure 14:
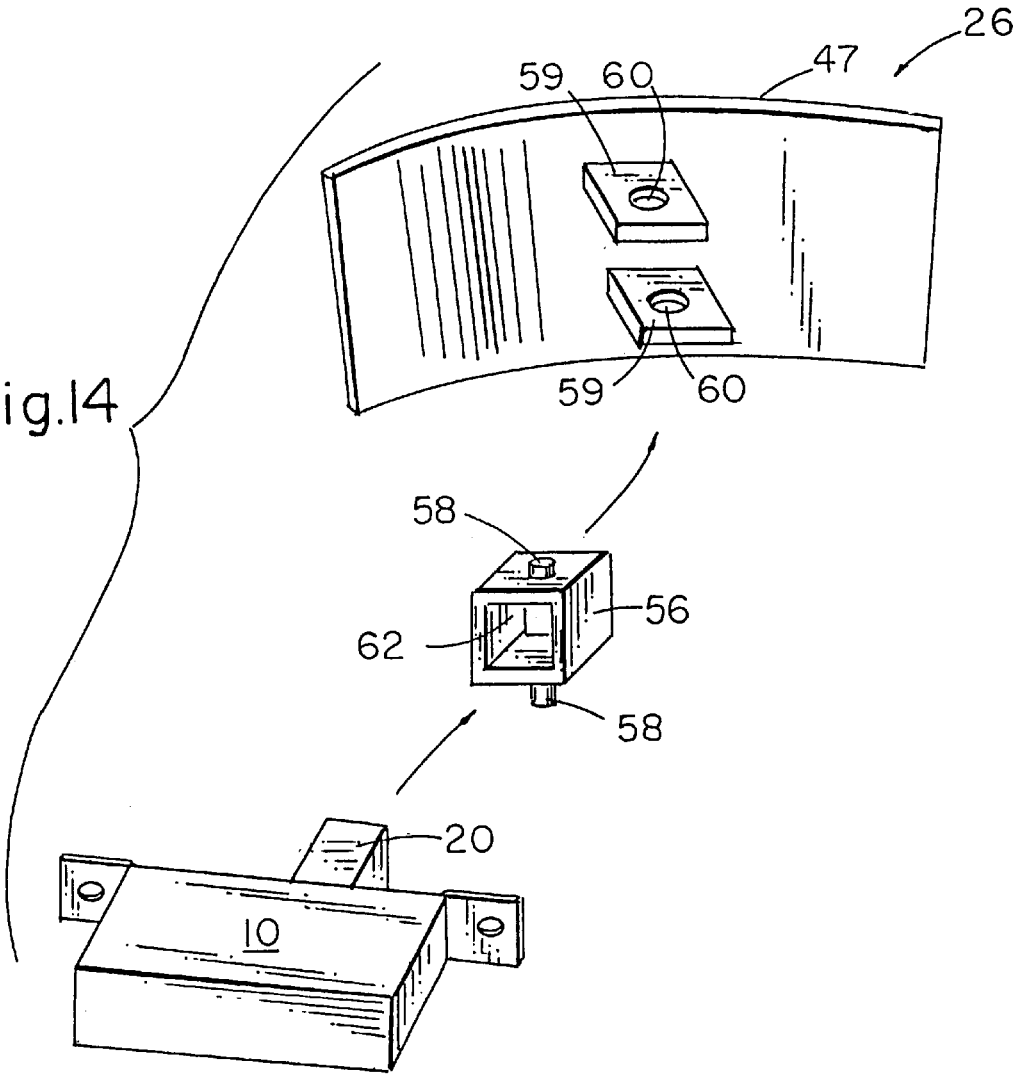
FIG. 14 is a perspective view, partially exploded, of the reverse switch cover embodiment of FIG. 13.

Finally, still another smooth configuration 47 embodiment of the switch cover 26 of the invention is shown in FIGS. 13 and 14. Similar to the embodiment shown in FIGS. 10–12, this embodiment is intended to be used with a recessed reverse switch as shown in FIG. 11. However, this embodiment includes a square-shaped adapter 56 having extending side axles 58 that engage into holes 60 formed in tabs 59 extending from the inside of the smooth configuration 47. The adapter 56 includes a square-shaped hole 62 for engaging the switch knob 20. Preferably, the dimensions of the square-shaped hole 62 allow the adapter 56 to be press fitted onto the switch knob 20 and held into position by such tight fit. The side axles 58 cooperating with tabs 59 allow the adapter 56 to pivot slightly. As should be appreciated, once the cover 26 is pressed into position, it can be easily moved back and forth to actuate the switch 10 in its two positions. The pivoting nature of the adapter 56 assures that no binding of the switch knob 20 relative to the cover 26 during switching due to the linear movement of the switch knob 20 versus the arcuate movement of the cover 26 itself.

Figure 14A:
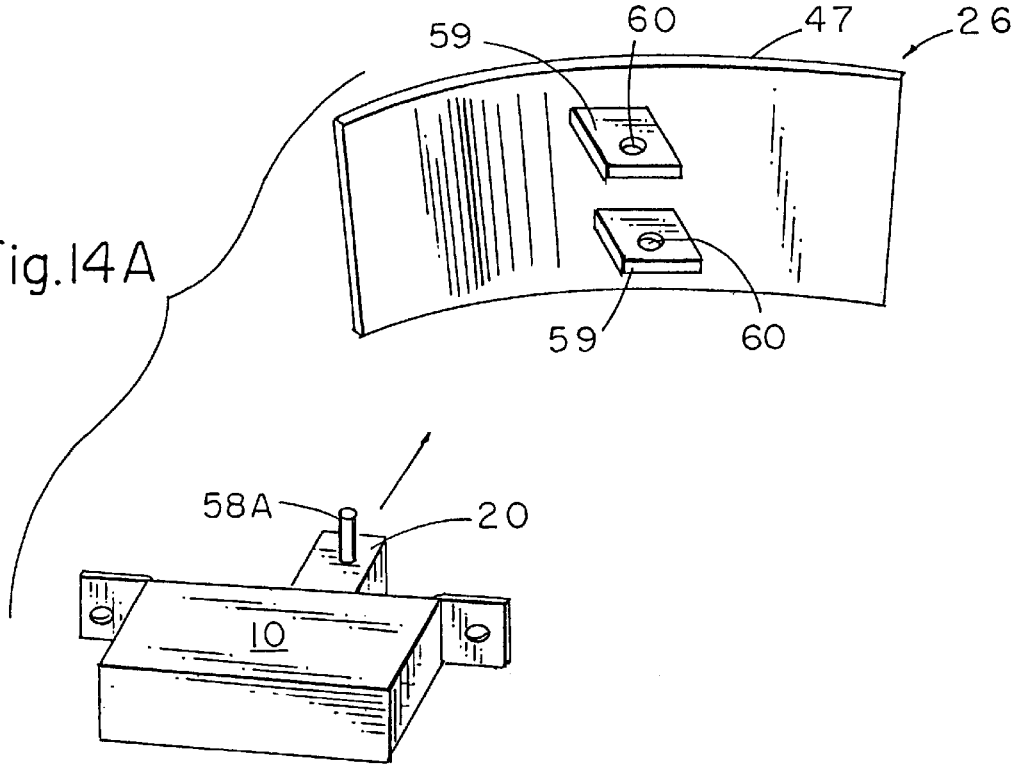
FIG. 14A is a perspective view, partially exploded, of the reverse switch cover embodiment of FIG. 13 wherein the switch knob includes axles that eliminate the need for the adapter.

As shown in FIG. 14A, the need for adapter 56 may be eliminated by forming or molding axles 58A directly in or integral with the switch knob 20.

Figure 5:
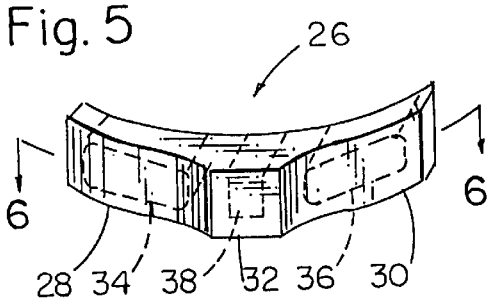

It is noted that all of the embodiments of the reverse switch cover 26 of the invention may be molded into the arcuate shape such as shown in FIGS. 5 and 6 from a resilient material, such as a plastic, having memory. In this manner, the natural arcuate configuration of such a reverse switch cover 26 may be used in connection with a reverse switch 10 positioned transversely as shown in FIG. 2 to follow the radius of the switch housing 12 as the cover is moved back and forth. Alternatively, due to the inherent resiliency of the cover 26, the cover 26 may alternatively be used in connection with a reverse switch 10 positioned longitudinally as shown in FIG. 1 since the arcuate cover 26 may be resiliently forced into a smooth configuration to lie flush with the longitudinal outer surface 17.

Pull-Chain Grommet and Coupler Assembly

Figure 15:
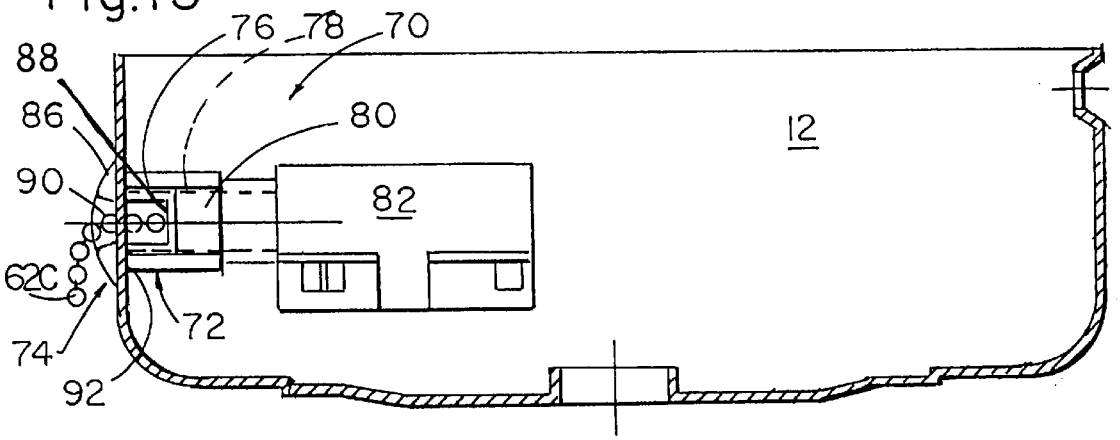
FIG. 15 is a cross-sectional view of the pull chain grommet and coupler assembly of the invention.

Another aesthetic component of the invention comprises a pull chain grommet and coupler assembly 70 that is intended to replace the older-style knurled nut that is typically employed for mounting a pull chain switch through a hole in the switch housing 12. More particularly, as shown in FIG. 15, the pull chain grommet and coupler assembly 70 of the invention comprises a coupler 72 and a grommet 74.

The coupler 72 comprises a generally cylindrical design having a longitudinal hole 76 extending therethrough. The longitudinal hole 76 comprises a thread 78 which is appropriately dimensioned for threaded engagement with the threaded neck 80 of a conventional pull chain switch 82.

Grommet 74 includes a generally dome-shaped outer configuration 86 with a threaded neck 88. A longitudinal hole 90 extends therethrough.

During installation, first the coupler 72 is threaded onto the threaded neck 80 of the switch 82 (with the pull chain 62C being positioned through the longitudinal hole 76). The grommet 74 is then positioned through a mounting hole 92 formed in the wall 18 of the switch housing 12 (with the pull chain 62C being positioned through its longitudinal hole 90) and then rotated to threadably engage its threaded neck 80 into the thread 78 of the coupler 72. Upon tightening, the assembly 70 is rigidly secured about the hole 92.

Figure 16:
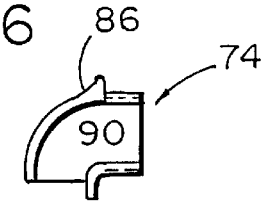
FIG. 16 is a cross-sectional view of a tapered modification to the grommet of FIG. 15.

As shown in FIG. 16, the outer configuration of the grommet 74 may be tapered downwardly so that precipitation such as rain does not flow into the switch housing 12.

Canopy Screw Cover

Figure 17:
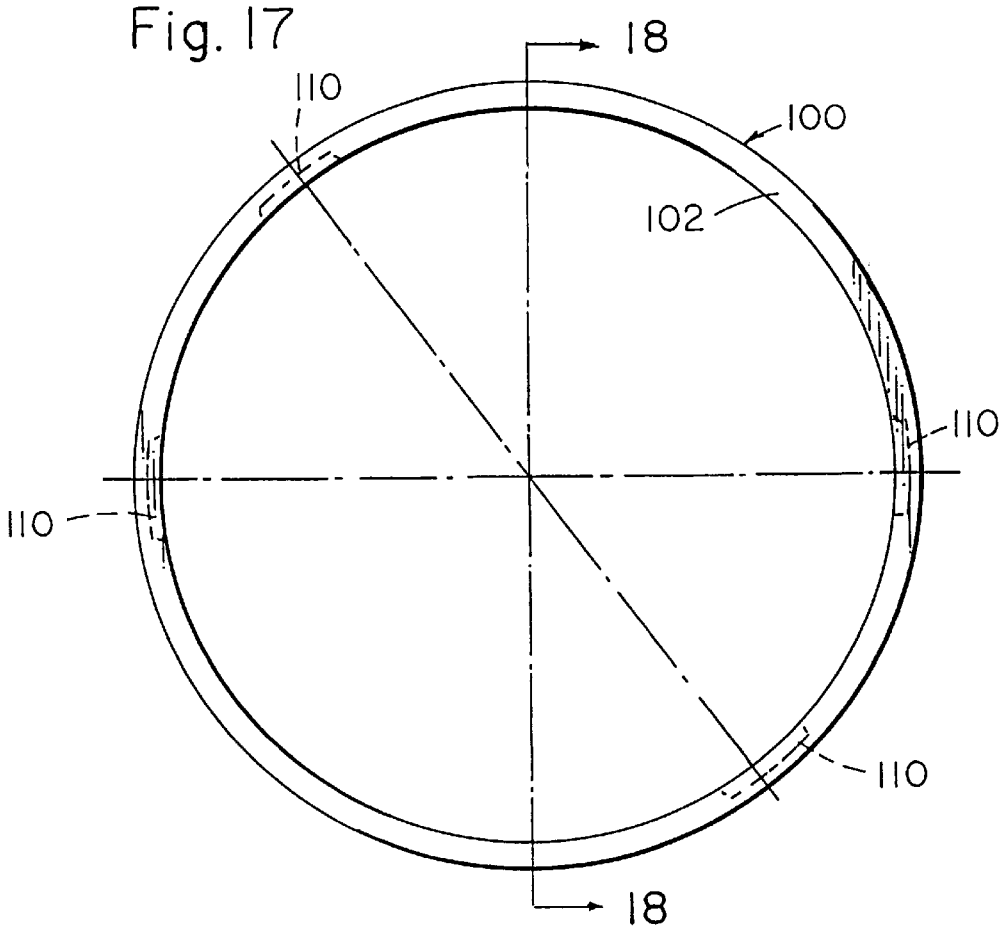
FIG. 17 is a top plan view of the canopy screw cover of the invention.
Figure 18:
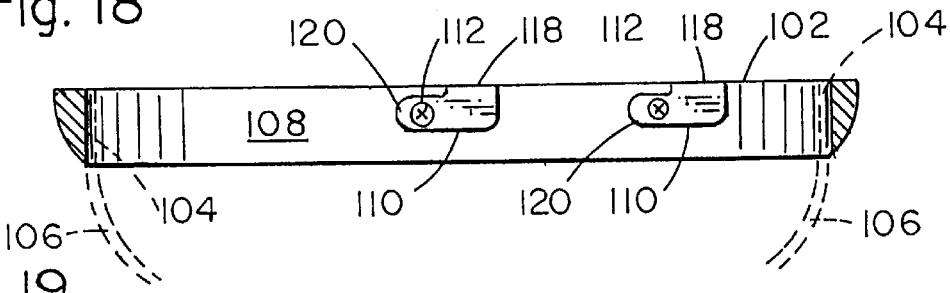
FIG. 18 is a cross-sectional view of FIG. 17 along lines 18—18 illustrating the J-shaped recesses formed in the inside surface of the cover.

Referring now to FIGS. 17 and 18, the canopy screw cover 100 of the invention comprises an annular ring 102, preferably substantially circular cylindrical in shape and having a inside diameter dimensioned for slidable engagement with the upper rim 104 of the canopy 106 of a ceiling fan (not shown). The inside surface or lumen 108 of the ring 102 includes a plurality of J-shaped recesses 110 that are dimensioned to slidably screw heads 112 that secure the canopy 106 to the hanger bracket (which is in turn rigidly secured to the electrical junction box from which the ceiling fan is suspended).

The J-shape of the recesses 110 each includes an opened end 118 positioned longitudinally and a blind end 120 positioned transversely. The number of and angular positioning of the J-shaped recesses 110 are determined to coincide and be in alignment with the screw heads 112. During assembly, the ring 102 is positioned concentrically with the upper rim 104 of the canopy 106 with the opened end 118 in alignment with the heads 112. The ring 102 is then pushed onto the rim 104 and twisted such that the heads 112 move into the blind end 120 of the recesses 110. The ring 102 is thus secured in position to conceal the otherwise unsightly screw heads 112.

Figure 19:
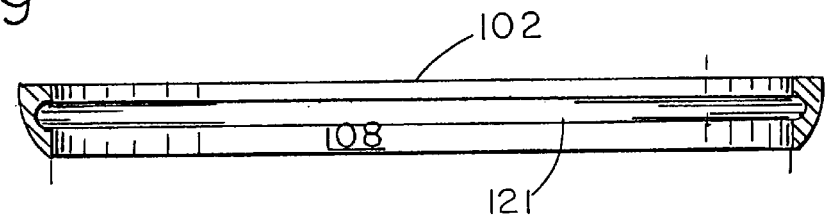
FIG. 19 is a cross-sectional view of another embodiment of the canopy screw cover of the invention illustrating an annular groove formed in the inside surface of the cover.

FIG. 19 is a cross-sectional view of another embodiment of the canopy screw cover 100 of the invention illustrating an annular groove 121 formed in the inside surface of the ring 102. The annular groove 121 is positioned midway of the ring 102 and includes a width slightly greater than the diameter of the screw heads 112. With the cover 100 being composed of a resilient material, it can been seen that it may simply be forcibly snapped about the upper rim 104 of the canopy 106 such that the screw heads 112 are positioned in the groove 121. Notably, due to the annular configuration of the groove 121, there is no need to assure alignment as in the case of the J-shaped recesses 110 of the embodiment described above.

Canopy Hole Cover

Figure 20:
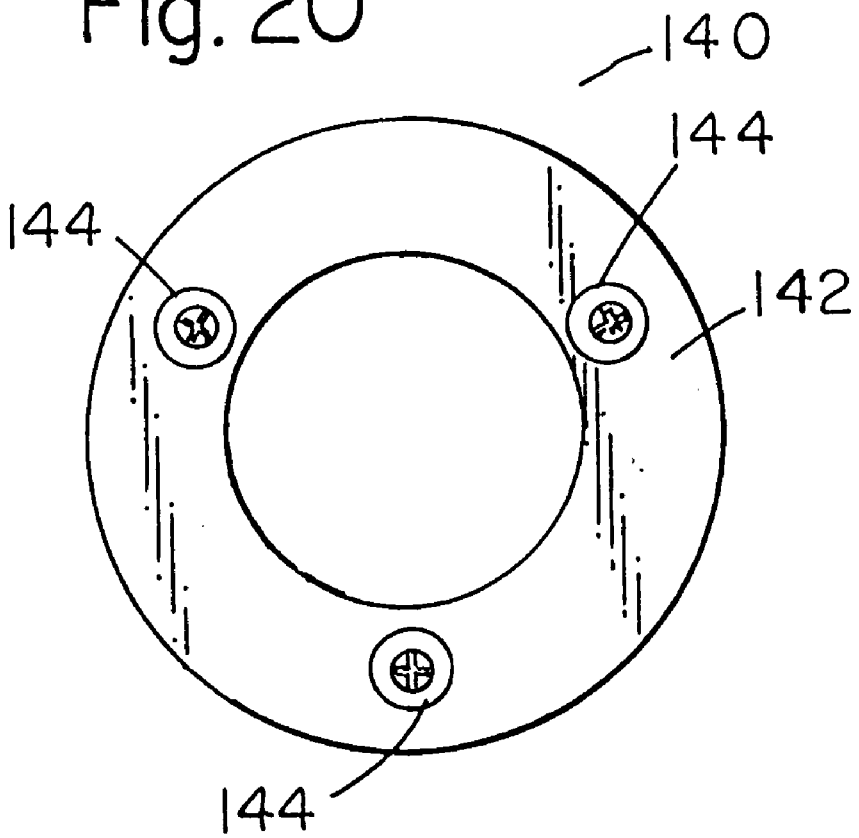
FIG. 20 is a top plan view of the canopy hole cover of the invention.
Figure 21:
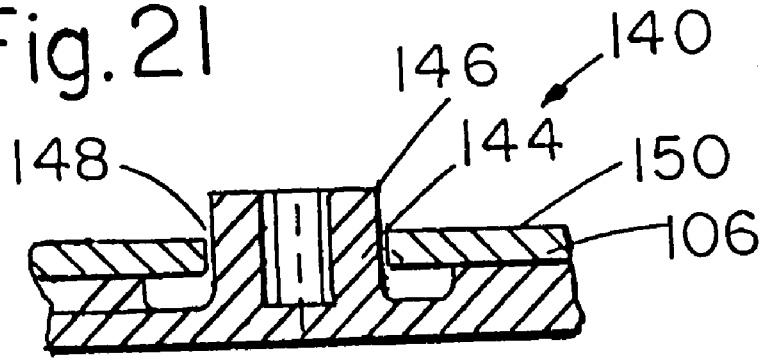
FIG. 21 is partial cross-sectional view of FIG. 20 illustrating the protrusions that secure the cover into position.

As shown in FIGS. 20 and 21, the canopy hole cover 140 of the invention comprises an annular flat plate 142 having a plurality of upwardly extending resilient protrusions 144. The protrusions 144 each include an inwardly deformable end 146 with memory. The protrusions 144 are angularly positioned to be in alignment with screw holes 148 formed in the lower rim 150 of the canopy 106.

During installation, the protrusions 144 are aligned with the respective holes 148 and then pushed to be snapped into place. The mushroom shape of the protrusions 144 releasably secure the cover 140 into position. The unsightly holes 148 are entirely concealed from view.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A canopy assembly, comprising in combination:

a bracket;

a ceiling fan canopy;

a mounting screw having a head;

said mounting screw connecting an upper portion of said ceiling fan canopy to said bracket; and an annular ring being made of a resilient material for mounting said annular ring about said ceiling fan canopy, the annular ring including an inner diameter appreciably greater than the diameter of the upper portion of said ceiling fan canopy allowing the head of the mounting screw to fit therein such that said annular ring completely covers said head of the mounting screw when said annular ring is positioned about said upper portion of said ceiling fan canopy.

2. A canopy assembly, comprising in combination:

a bracket;

a ceiling fan canopy;

a mounting screw having a head;

said mounting screw connecting said ceiling fan canopy to said bracket;

an annular ring, and a recess formed in said annular ring in which is positioned the head of the mounting screw when said annular ring is positioned about said canopy, said annular ring completely covering said head of the mounting screw.

3. The canopy assembly as set forth in claim 2, wherein said recess includes a substantially J-shaped configuration with a blind end and an opened end allowing removable mounting of said annular ring by alignment of the head of the mounting screw with said opened end; and said annular ring being rotationally secured to the head of the mounting screw through the blind end of the recess.

4. The canopy assembly as set forth in claim 2, wherein said recess includes a substantially annular configuration allowing removable mounting of said annular ring; and said annular ring slidably engaging the head of the mounting screw into the recess.

* * * * *